United States Patent [19]

Brault et al.

[11] 4,448,640

[45] May 15, 1984

[54] PROCESS AND DEVICE FOR MOLDING AND DRYING OBJECTS MADE OF FIBROUS MATERIALS

[75] Inventors: Bernard Brault, Paris; Paul H. Marchal, Thann, both of France

[73] Assignee: Societe Anonyme dite: Air Industrie, France

[21] Appl. No.: 345,697

[22] Filed: Feb. 4, 1982

[30] Foreign Application Priority Data

Feb. 17, 1981 [FR] France ..... 81 03099

[51] Int. Cl.[3] ..... D21J 7/00

[52] U.S. Cl. ..... 162/218; 162/226; 162/375; 162/376; 162/391

[58] Field of Search ..... 162/218, 226, 228, 375, 162/376, 388, 391, 387; 264/86, 87

[56] References Cited

U.S. PATENT DOCUMENTS 1,848,055 3/1932 Chaplin ..... 162/226

*Primary Examiner*—Peter Chin

*Attorney, Agent, or Firm*—Scully, Scott, Murphy & Presser

[57] ABSTRACT

The invention concerns a process and device for molding and drying objects made of fibrous materials.

The device comprises a cylinder 12, rotating about its longitudinal axis, having a row of porous molds 18 along the lengths of said cylinder's lateral faces, partially dipping into a vat 10 maintained with a constant level of fibrous product paste made of an appropriate liquid, a tubule 20 which connects the interior of the cylinder with a source of vacuum so as to create a partial vacuum therein, said cylinder 12 surrounded on its entire lateral surface free between paste vat 10 and removal device 22 by an arrangement of insulating walls 42 which define with cylinder 12 and vat 10 an enclosure 44 into which opens passageway 46 conveying hot air, said hot air being dwarfed from the extraction of air from a dryer.

The present invention notably applies to the formation of egg boxes.

3 Claims, 4 Drawing Figures

PROCESS AND DEVICE FOR MOLDING AND DRYING OBJECTS MADE OF FIBROUS MATERIALS

BACKGROUND OF THE INVENTION

The present invention concerns a process for molding and drying objects made from fibrous materials in a paste or liquid suspension. Generally, a paste is continuously applied to molds attached to a mobile part, and a fabricated object is consequently removed and dried in a known dryer.

DESCRIPTION OF PRIOR ART

According to known embodiments one utilizes porous molds attached to a hollow cylinder, containing a partial vacuum, rotating about its longitudinal axis, said cylinder plunger into a paste which is drawn into the molds by the aforesaid depression. Draining of the paste liquid occurs during the rotation of the aforesaid cylinder until each mold or row of molds comes in front of a post for removing objects from said molds. The aforesaid objects are then transported to a dryer by a well-known belt arrangement.

To avoid using a cylinder having overly large dimensions, the removal from the molds is carried out as soon as the molded products are sufficiently drained, in practice when said products attain approximately 25% dryness. The molded products contain approximately three times their weight in liquid which must eventually be evaporated in a dryer. Thus, two major inconveniences result:

the dryer dimensions are very important;

a great deal of thermal energy is required for the operation.

To remedy the first of the abovementioned disadvantages, one has proposed, by analogy with certain rotating dryers, surrounding the cylinder carrying the molds by panels radiating, for example, infrared heat or by a supply of hot air. Such heating greatly accelerates draining, but there is an accompanying lack of homogenity as evidenced by the formation of a crust on the product.

Moreover, the above heating system can not be operated with any reduction of energy consumption.

SUMMARY OF THE INVENTION

The present invention has for its object the elimination of the abovementioned inconveniences, and concerns a process of molding and drying which is characterized by a partial vacuum created in the interior of a cylinder, sufficiently important to draw in the product paste into a mold, at the moment said mold is immersed in a vat containing said paste, and produces an air movement across the product and said porous mold, and furnishes hot air over the entire exterior surface of said cylinder between the exit from the paste vat and the entrance to the post for removing objects from the molds.

Such a process has the following advantages:

Heating "in the bulk" of a molded product guarantees good homogenity of said product and allows acceleration of its draining because of the reduction in viscosity of the paste liquid. As the temperature increases, viscosity diminishes and, consequently, facilitates easy draining thereof. The recovery of hot and more humid air issuing from the dryer permits a further increase in thermal energy economy as well as an increase in the quantity of liquid drained, since the drying air is used to the maximum of its heating potential.

There results an economy of energy and a possible reduction of the dimensions of the cylinder, at the same time there is the feasibility of increasing the rotational speed of said cylinder, and consequently the speed of production.

The increase in aspiration heightens the density of the molded product, thus eliminating defects.

The obtained predrying reduces the importance of a subsequent drying and the overall cost of drying as well.

Moreover, it is ascertained that, paradoxically, the dryness obtained by predrying is greater when the hot air is more humid. The theoretical explanation is not exactly known. One proposes that the surplus of liquid is purged beyond the reduction of evaporated liquid. Furthermore, one economizes the corresponding latent heat. One also benefits from the large heat mass of the humid air utilized, said air carrying more recoverable calories than dry air, thereby facilitating draining.

For example, the combination of all the abovementioned actions allows a removal of an object, having attained at least 38% dryness, from a mold, instead of 25% as in known processes. An important advantage is the reduced risk of deformation during removal from the mold. Moreover, if one wishes to attain a final dryness of 90%, the quantity of liquid remaining to be evaporated is reduced by more than 40%. Thus, a considerable reduction of thermal energy required for the operation results.

The present invention also concerns a device for molding and drying fibrous material objects using the aforementioned process.

The drying and heating device comprises a cylinder rotating about its longitudinal axis, carrying along the length of its lateral faces a row of porous molds, partially dipping into a vat maintained with a constant level of fibrous product paste made of an appropriate liquid, a tubule connecting the interior of the cylinder to a source of vacuum so as to create a partial vacuum therein, a device for removing and transferring objects from molds which periodically and successively applies itself to each row of molds, and a belt conveying the products to a dryer. The drying device is characterized in that the cylinder is surrounded on its entire lateral surface between the paste vat and the removal device by an arrangement of insulating walls which define with the cylinder and the vat an enclosure into which opens a passageway conveying hot air, and the latter is connected to a collector which in its turn joins extraction tubules from a dryer, said dryer drying the objects.

BRIEF DESCRIPTION OF THE DRAWINGS

Several embodiments of the present invention will be hereafter described with reference to the annexed drawings in which.

DETAILED DESCRIPTION OF THE DRAWINGS

Figure 1:
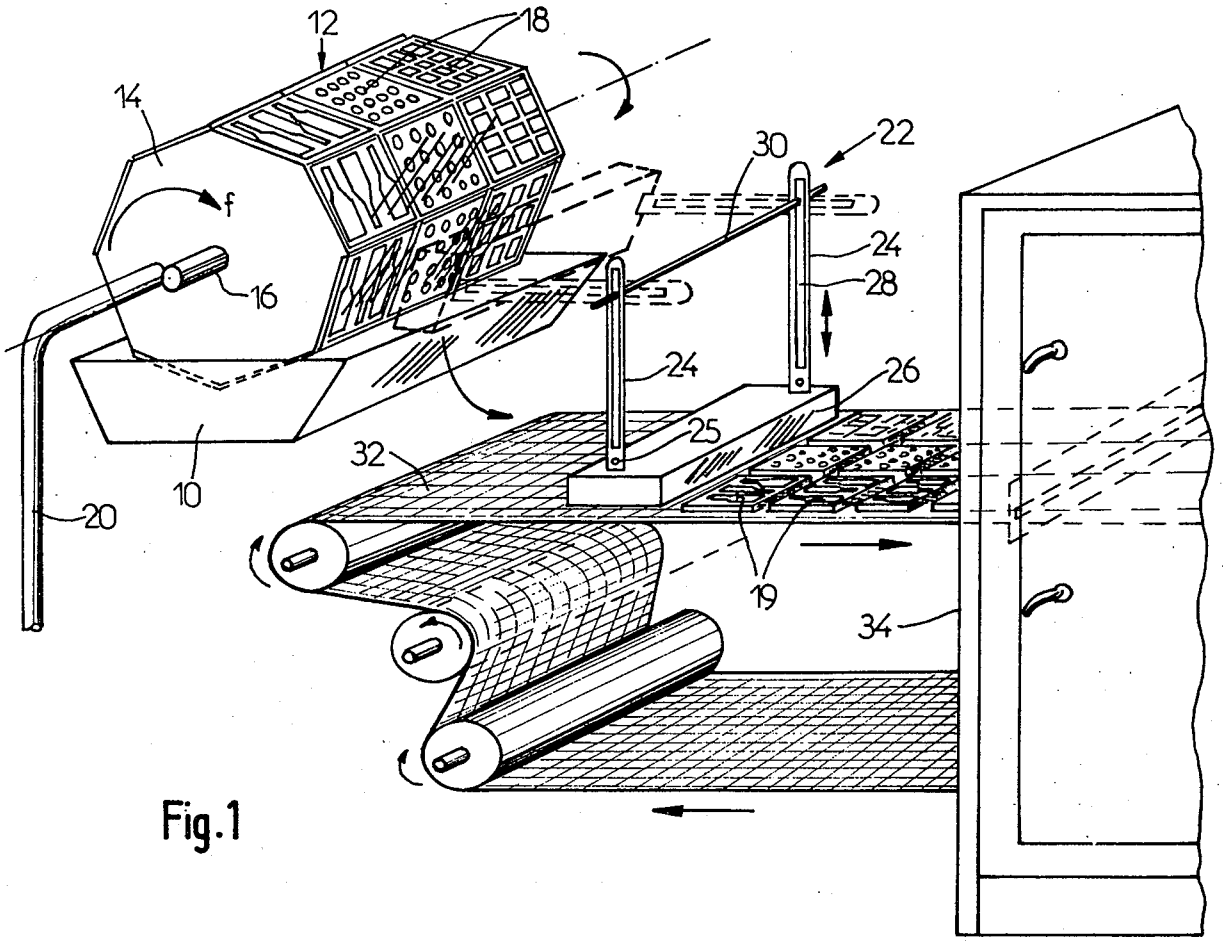
FIG. 1 is a perspective view of a known molding and drying device.

The known molding and drying device represented in FIG. 1 molds objects from a paste of fibers materials in an aqueous or other type of solution contained in a vat 10. The device consists of a hollow cylinder 12 sealed at both ends by polygonal bases 14. Cylinder 12 is mounted around a longitudinal axis of rotation 16, and each of the faces of said cyclinder 12 has a mold or a row of molds 18 which are porous vis-a-vis air and the paste liquid. The lower part of cylinder 12 plunges into the paste.

The paste is drawn into the porous molds on the immersed face of cylinder 12 by a partial vacuum established in said cylinder, by a source of vacuum not shown, by tubule 20 which enters one of the walls of the base 14 of cylinder 12 by means of an air tight rotary connection. Tubule 20 is connected to the source of vacuum by a means for separating air and liquid from the paste.

The drainage of the liquid occurs during the rotation of cylinder 12 in the direction indicated by arrow f, from the time the mold leaves vat 10 until it passes in front of a post for removing and transferring the object from the mold. At this post is mounted, in a partial vacuum, a conventional type of device 22 for removing objects from molds, consisting of two arm supports 24 connected at the lower ends by joints 25 to a hollow body 26 having a form complementary to the mold or row of molds on each lateral face of cylinder 12. The interior volume of body 26 may be placed in a partial vacuum. The arms 24 have longitudinal slots 28, and said arms are traversed by a fixed support axis 30 interdependent with the frame structure, which is not shown, of the device because it is outside the scope of the present invention. The arrangement is able to pivot around axis 30 and slide about the aforesaid axis; the body 26 being capable of remaining applied on the molds which are opposite the post of removing objects from molds until removal is complete.

An appropriate mover mechanism, not shown, is foreseen in order to displace the device for removing objects from molds between a removal position shown in broken lines in FIG. 1 and the transferral position shown in solid lines, in which the molded objects 19 are deposited on an infinite conveyor belt 32, for example, a metallic gauge. The molded objects are transported by the belt 32 to a dryer 34.

Figure 2:
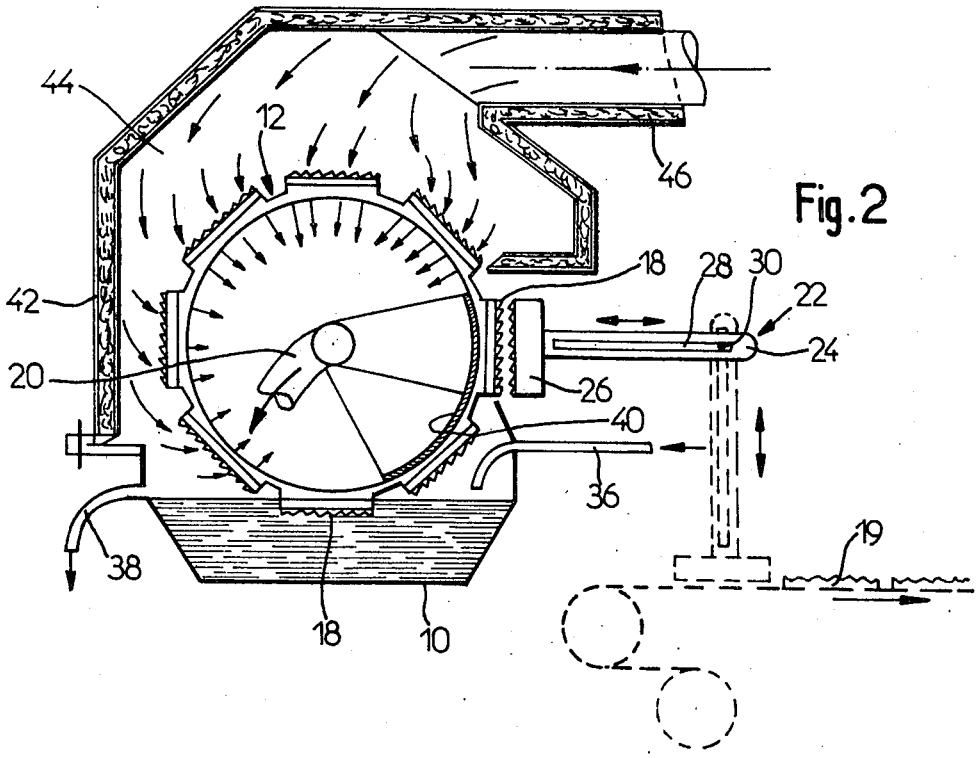
FIG. 2 is a sectional end view of a cylinder, showing partially the molding and drying device according to a first embodiment of the present invention.

With reference to FIG. 2, the drying device according to the present invention is distinguished from the one in FIG. 1 in that:

- the paste in vat 10 is maintained at a constant level by means of a supply (feeding) tubule 36 and an overflow tubule 38. Thereby, the concentration of fibrous material is maintained at a constant value;
- the initiation of the forming-by-mold process by aspiration is facilitated by a means which eliminates a partial vacuum on the side of a mold directed towards the cylinder interior. In the represented example, the aforesaid means is made up of a screen or guard 40 in the form of a cylindrical section applied against the internal face of cylinder 12;
- cylinder 12 is surrounded on its entire external lateral surface free between paste vat 10 and removal device 22 by an arrangement of insulating walls 42 which define with cylinder 12 and vat 10 an enclosure 44. A flux of hot air is blown into the aforesaid enclosure through passageway 46;
- a delivery of hot air, more important than the one circulating in cylinder 12 of FIG. 1, passes through the interior of cylinder 12 of FIG. 2.

The present invention functions in the following manner: at the moment a mold or a row of molds 18 is immersed in vat 10, the partial vacuum exerts itself on tubule 20 and porous molds 18 to draw in the paste against the aforesaid molds. Molds 18 retain the fibrous material, while the liquid is sucked in by air to the interior of cylinder 12.

The products in molds 18 being rotated by cylinder 12 around its own axis drip, but the important action created by the aspirating means across porous molds 18 and the fibrous materials serves, not only to maintain said material in molds 18, but equally to draw off a great deal of liquid which evaporates in passing.

The separating means, which precedes the aspirating means, retains the liquid, whereas the vapor-filled air is blown to the exterior. Heat can thereby be recovered through recycling of said liquid.

The gain in draining time, according to the present invention, produces an important advantage: the diameter of the cylinder can be reduced. The mechanical inertia of the cylinder decreases; thus, rendering possible noncontinuous rotation of the cylinder, in contrast to, known drying devices in which the cylinder movement must be continuous. The cylinder movement is intermittent according to a sequence permitting a stoppage time for the passage of each row of molds 18 in the paste vat 10 and then also in front of removal device 22.

In starting from the position illustrated in FIG. 2, in which one supposes that the cylinder 12 comes to a stop, the sequence of movements is as follows:

- the removal device 22, which is initially in a horizontal position, slides towards the left until body 26 comes against molds 18 which are positioned for having the objects removed from said molds. The products contained in the aforesaid molds are aspirated by the depression in body 26, and the aspiration being facilitated by the fact that the action of the partial vacuum which exerts itself at the interior of cylinder 12 is cancelled on a level with screen 40; the removal device 22 separates from cylinder 12 by sliding towards the right,
- it then executes a rotation of a quarter of a turn until it comes to the position illustrated by the broken lines, in which the molded objects are above drying belt 32;
- the removal device 22 then slides towards the bottom until the molded products are in contact with the belt 32. The partial vacuum in body 26 is then released and products 19 are removed from the molds;
- the removal device 22 slowly climbs towards the top, and;
- it executes a rotation of a quarter of a turn towards the top, thereby regaining its departing position.

The present system is capable of a timing more rapid than known devices of the same type.

Figure 3:
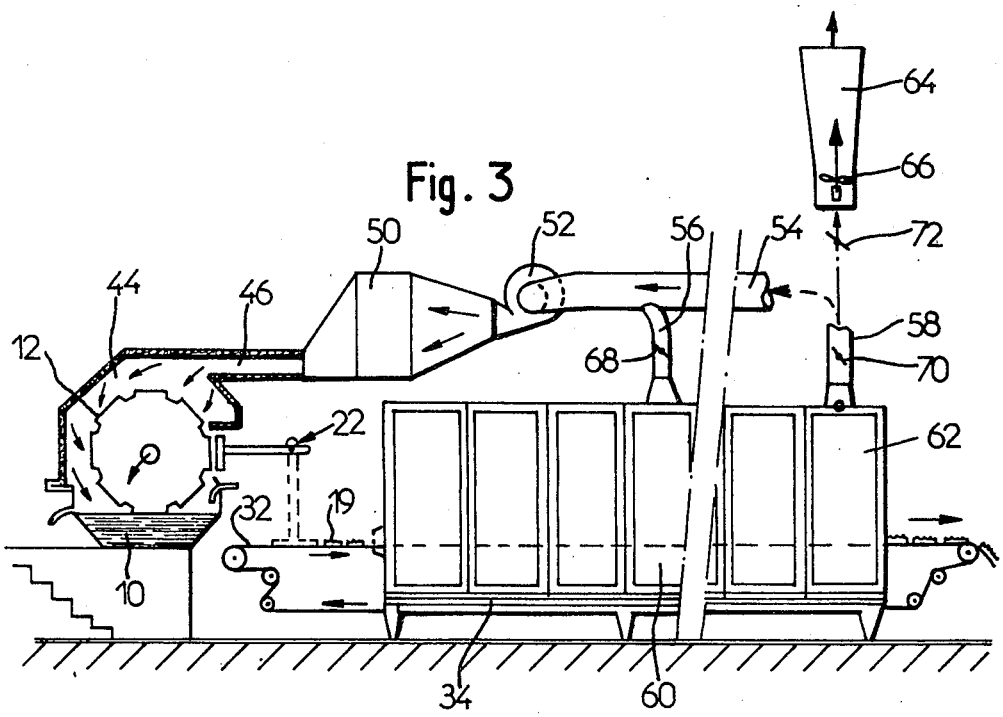
FIG. 3 is a side elevated view, partially in cross-section, of the complete molding and drying installation according to the present invention.

In the embodiment illustrated in FIG. 3, the passageway 46 delivering a flux of hot air is joined, by reheater 50, to a ventilator 52 and a collector tubule 54 to extraction tubules issuing from different sections of dryer 34. For simplification, two extraction tubules 56,58 corresponding to sections 60,62 have been represented. The extraction tubule 58 positioned further downstream from dryer 34 is also connected to a tubule for evacuation to the atmosphere 64 equipped with a ventilator 66. Tubules 56,58, and 64 are respectively provided with butterfly valves 68,70, and 72 which regulate the delivery of hot air evacuated at the different sections of the dryer towards the collector tubule 54 and towards the evacuation to the atmosphere 64.

In this manner, a diversion is made of air which has already accomplished a drying of the products in the dryer interior and which will continue to absorb the vapor emitted from the predrying of the same products before their entry into the dryer.

The diversion can occur at several sites corresponding to several successive sections of the dryer: one can act upon the most dry air, issuing from the downstream sections, or advantageously from more humid air issuing from more upstream sections, but capable of absorbing the vapor, or even a mix of air from diverse orgins. One will choose the compromise best adapted to the most economical arrangement for the dryer and predrying.

One can anticipate a recovery of heat in evacuation tubule 64. It is even possible to totally eliminate this evacuation, the totality of air extracted from the dryer being then recovered and sent back to the enclosure 44.

Reheater 50 is supplied by a primary heating fluid of any kind: vapor, heat-conveying fluid, hot air, combustion gas. There can be a heater of the surface-exchange or mixture type.

Figure 4:
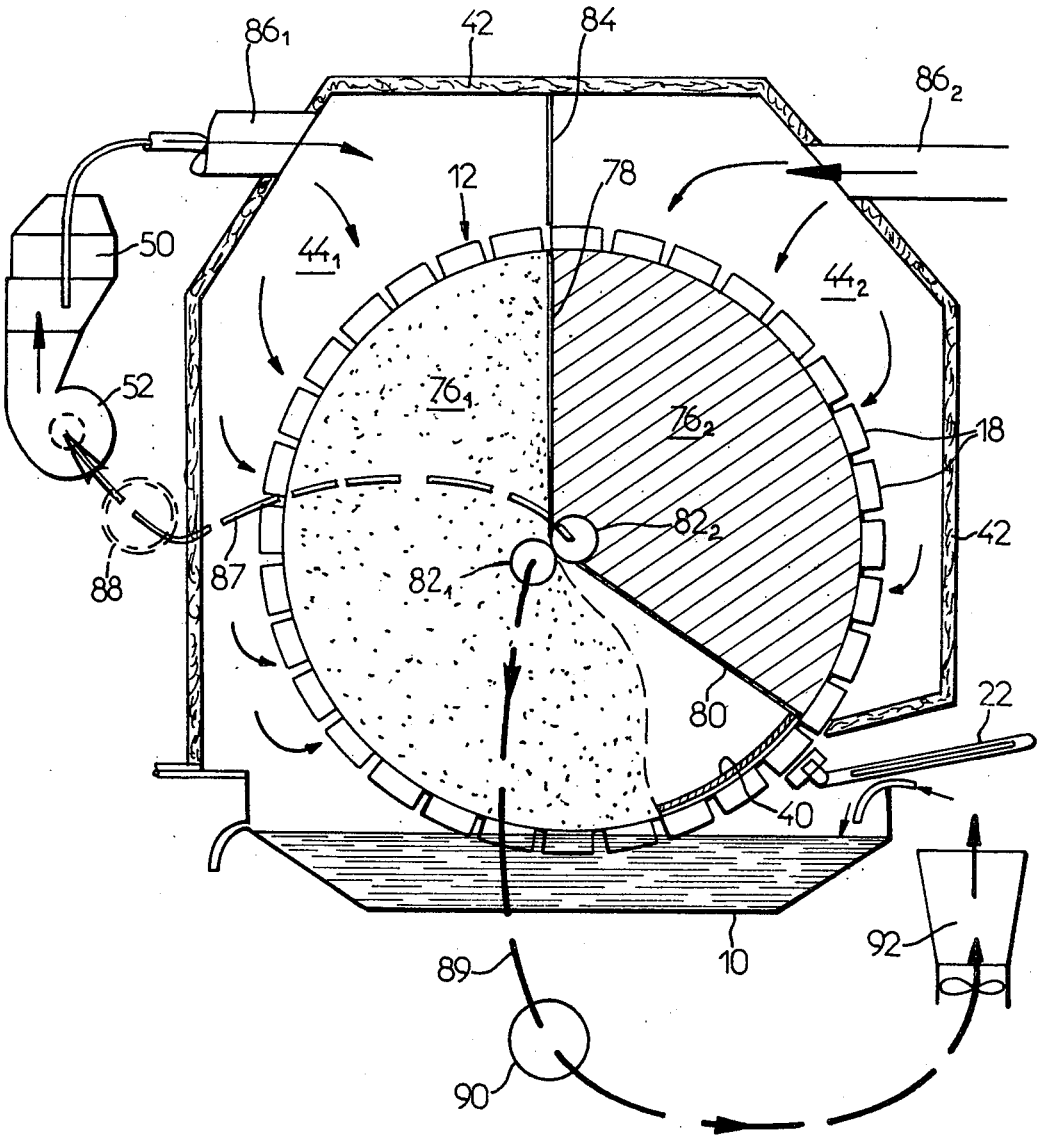
FIG. 4 is a sectional view of a drying device according to a second embodiment of the present invention.

In the embodiment of FIG. 4, cylinder 12 has an interior divided into two chambers $76_1$ and $76_2$, in the form of cylindrical sections, by radial partitions 78,80 fixed in relation to cylinder 12, so that the aforesaid chambers are fixed in space and time. Partition 80 terminates opposite the edge of insulating partition 42 adjacent to removal device 22.

At chambers $76_1$ and $76_2$ are associated, respectively, tubules for application of a partial vacuum $82_1$, $82_2$, adjacent to each other on the diagram, but are capable of being concentrically positioned.

Furthermore, the interior enclosure formed by insulating partitions 42 is also divided into two enclosures $44_1$ and $44_2$ by a fixed partition 84. Enclosure $44_2$ receives by a passageway $86_2$ newly-heated air. As for enclosure $44_1$ it plays exactly the same role as enclosure 44 in the embodiment represented in FIG. 2. A flux of hot air, drawn in by a vacuum pump 88 joined to an aspiration tubule $82_2$ from chamber $76_2$ by a conduit schematized by 87, is drawn back by a ventilator 52 joined with reheater 50 connecting to passageway $86_1$ to enclosure $44_1$.

As shown in FIG. 4, removal device 22 and screen 40 are positioned as close as possible to vat 10. Thus, one increases to a maximum the drying time.

Tubule $82_1$, is connected, by a conduit schematized by 89, to a vacuum pump 90 which is connected to tubule 92; air introduced into chamber $76_1$ is evacuated to the atmosphere via the abovesaid arrangement.

The uniqueness of the device in FIG. 4 is the following: in enclosure $44_2$ circulates the molded products which have already been drained and predryed in enclosure $44_1$ according to the process of the embodiment of the present invention in FIG. 2. Enclosure $44_2$, fed directly with hot, dry air, performs in the same manner as the dryer in FIG. 2. Hot air passes over the products to be dried and the porous molds 18, so that one benefits from the exchange "in the bulk" as already mentioned. Thus, the dryer shown in FIG. 2 can be totally eliminated or at the least greatly reduced, a part of the drying occurring in enclosure $44_2$.

The air aspirated by tubule $82_2$ and which exits from chamber $76_2$ replaces the hot air diverted from the dryer of FIG. 2. Said air is directly taken by pump 88, then diffused into enclosure $44_1$ and used in chamber $76_1$ as previously explained.

As for the air aspirated by tube $82_1$ into the draining and predrying chamber $76_1$, it is then blown to the exterior as in the preceding example.

The present invention can be applied to all products made from fibrous materials in suspension, such as:

- cellulose from paper waste and carton pulp,
- "new" cellulose provided directly from wood or a mixture of new cellulose and cellulose from paper pulp,
- fire-proof, ceramic, rocky, chemical, or others fibers,
- peat or other vegetation products,
- in general, all fibrous products capable of being molded by aspiration on a mold porous to air and water, or from any paste containing chemical products capable of influencing chemical, physical, or mechanical qualities of a molded product after drying.

Among the products which can be made, one uniquely cites as non-limiting examples:

- eggboxes and trays,
- trays for packaging and protecting bottles,
- small packaging means for fruits, vegetables, and other edibles,
- packaging for protection of manufactured, industrial products, such as electrical appliances,
- thermal or acoustic isolation panels,
- saucers (shallow dishes) for sowing seeds and culture, and
- liquid containers, capable of being made impermeable.

What is claimed is:

1. A device for molding and drying articles made of fibrous materials, of a type having a cylinder turning around its longitudinal axis, said cylinder carrying along the length of its lateral faces a row of porous molds, said molds partially dipping into a vat maintained with a constant level of a fibrous product paste made of an appropriate liquid, means for removing and transferring articles from said molds which periodically and successively applies itself on each of the aforesaid row of molds, and a belt conveying the products to a dryer, characterized in that said cylinder (12) is surrounded on its entire lateral surface between paste vat (10) and said removing and transferring means (22), by an arrangement of insulating walls (42) which define with cylinder (12) and vat (10) an enclosure (44) into which opens a first conduit for conveying hot air (46) and connected in series to a ventilator (52), a reheater (50), and a second conduit (54) to which are connected a plurality of extraction conduits located along the length of the dryer (56) for extracting heated air therefrom and an exhaust conduit (64) to the atmosphere; wherein the interior volume of said cylinder (12) is divided by first and second radial partitions (78,80), fixed in space, into a first draining and predrying chamber ($76_1$) and a first drying chamber ($76_2$), both in the form of cylindrical sections, said second partitions (80) terminating opposite an edge of the insulating wall (42), contiguous with said removing and transferring means (22); said enclosure also being divided by a third partition (84) positioned radially outwardly of the first radial partition (78) said third portion together with the exterior surface of the cylinder (12) and walls of said enclosure define a second draining and predrying chamber ($76_1$), and a second drying chamber; ($44_2$) connected to said first draining and predrying chamber and said first drying chamber; said first conduit opening into said second drying chamber; a third conduit connecting a heating means for heating new air to said second raining and predrying chamber.

2. A device according to claim 1, wherein said first draining and predrying chamber and said first drying chamber chambers ($76_1$, $76_2$) are connected to the means for creating a vacuum, by separate conduits ($82_1$, $82_2$).

3. A method of molding and drying articles made of fibrous materials contained in a paste or suspension by utilizing porous molds connected to a hollow cylinder rotating about its longitudinal axis wherein a partial vacuum prevails, said cylinder dipping into a container of said paste or suspension which is drawn into the molds by said partial vacuum, (a) creating a partial vacuum inside the cylinder said cylinder and said container positioned in an insulated enclosure; said enclosure being divided into fixed separate first draining and predrying zone and first drying zone; said cylinder internally divided into fixed separate second draining and predrying zone and second drying zone located opposite the respective first draining and predrying zone and first drying zone of said enclosure; passing newly heated air to said first draining and predrying zone, creating a partial vacuum in said second drying and predrying zone sufficient to deposit said paste or suspension onto said molds to form said articles and to drawn newly heated air contained in said first draining and predrying zone through the deposited paste or suspension and said porous molds; rotating said cylinder and said molds with deposited paste or suspension into said first drying zone, passing hot air collected from separate sections of a dryer located downstream of said enclosure into said first drying zone, creating a partial vacuum in said second drying zone to draw the hot air contained in the first drying zone through said deposited paste or suspension and said porous molds; further rotating said cylinder to a removal and transferal post, removing said deposited paste or suspension articles from said molds and transferring said articles to said dryer for further drying.

* * * * *